US011584131B2

(12) United States Patent
Cao et al.

(10) Patent No.: US 11,584,131 B2
(45) Date of Patent: Feb. 21, 2023

(54) INKJET ASSEMBLY, INKJET PRINTING APPARATUS AND INKJET PRINTING METHOD FOR USE IN PREPARATION OF DISPLAY COMPONENT

(71) Applicants: BOE TECHNOLOGY GROUP CO., LTD., Beijing (CN); Shanghai University, Shanghai (CN)

(72) Inventors: Jin Cao, Beijing (CN); Jinsong Zhang, Beijing (CN); Limin Yan, Beijing (CN); Chunming Ren, Beijing (CN); Xinguo Li, Beijing (CN); Xiao Wu, Beijing (CN)

(73) Assignees: BOE TECHNOLOGY GROUP CO., LTD., Beijing (CN); Shanghai University, Shanghai (CN)

( * ) Notice: Subject to any disclaimer, the term of this patent is extended or adjusted under 35 U.S.C. 154(b) by 0 days.

(21) Appl. No.: 17/483,885

(22) Filed: Sep. 24, 2021

(65) Prior Publication Data

US 2022/0184960 A1 Jun. 16, 2022

(30) Foreign Application Priority Data

Dec. 11, 2020 (CN) ..... 202011459587.4

(51) Int. Cl.
*B41J 2/175* (2006.01)
*B41J 2/14* (2006.01)

(52) U.S. Cl.
CPC ..... *B41J 2/175* (2013.01); *B41J 2/1433* (2013.01); *B41J 2002/14419* (2013.01)

(58) Field of Classification Search
CPC ..... B41J 2/175; B41J 2/1433; B41J 2002/14419; B41J 2/17523; B41J 2/17553;
(Continued)

(56) References Cited

U.S. PATENT DOCUMENTS

2010/0315471 A1* 12/2010 Kihira ..... B41J 2/14233 347/85

FOREIGN PATENT DOCUMENTS

CN 1256663 A 6/2000
CN 201525178 U 7/2010
(Continued)

OTHER PUBLICATIONS

China Patent Office, First Office Action dated May 26, 2021 for application No. CN202011459587.4.

*Primary Examiner* — Bradley W Thies
(74) *Attorney, Agent, or Firm* — Houtteman Law LLC

(57) ABSTRACT

The present disclosure provides an inkjet assembly, an inkjet printing apparatus and an inkjet printing method for use in preparation of a display component. The inkjet assembly is for use in an inkjet printing apparatus, including a jet printing member having a first surface. A main inkjet channel, a liquid-phase channel in communication with the main inkjet channel, and a gas-phase channel in communication with the main inkjet channel are formed in the jet printing member. An axial direction of the liquid-phase channel intersects an axial direction of the main inkjet channel, and an axial direction of the gas-phase channel intersects the axial direction of the main inkjet channel. An end opening of the main inkjet channel is formed as a nozzle on the first surface.

20 Claims, 5 Drawing Sheets

(58) Field of Classification Search
CPC ... B41J 2/17513; B41J 2/04; B41J 2/14; B41J 3/407
See application file for complete search history.

(56) References Cited

FOREIGN PATENT DOCUMENTS

| | | | |
|---|---|---|---|
| CN | 207014969 | U | 2/2018 |
| JP | 2012011679 | A | 1/2012 |
| KR | 20100112443 | A | 10/2010 |
| KR | 20160068083 | A | 6/2016 |

* cited by examiner

INKJET ASSEMBLY, INKJET PRINTING APPARATUS AND INKJET PRINTING METHOD FOR USE IN PREPARATION OF DISPLAY COMPONENT

CROSS-REFERENCE TO RELATED APPLICATION

This disclosure claims priority from Chinese patent application No. 202011459587.4 filed with China National Intellectual Property Administration (CNIPA) on Dec. 11, 2020, the contents of which is incorporated herein by reference.

TECHNICAL FIELD

The present disclosure relates to the technical field of inkjet printing of display devices, and particularly relates to an inkjet assembly, an inkjet printing apparatus and an inkjet printing method for use in preparation of a display component.

BACKGROUND

In the prior art, inkjet printing is used in preparation of a light-emitting layer, a display layer and the like of a display component. The inkjet printing of a display component typically needs to meet three technical requirements: high precision, high efficiency, and high speed. Specifically, high precision requires volumes of ink droplets deposited in each display element (pixel) remaining highly consistent; high efficiency requires the capability of printing a large area of pixels simultaneously with multiple nozzles; and high speed requires fast start and stop of the jet printing process, i.e., instantaneous response of the jet printing action, in response to high speed movements and translation of the display component. Inkjet printing a display component with a solution method shows the development direction of the next generation of display component printing. In the solution method, a fluid is taken as the printing material for preparation of the light-emitting layer and the display layer of the display component. The fluid used therein may be an organic or inorganic solution. Between pixel cells of the display component, there are banks. When the display component is inkjet printed using the solution method, since the fluid generally has the characteristics of large inertia and low response speed, the fluid will fall onto the banks and then flow into the pixel cells near the banks if the start and stop of the jet printing process is not performed timely enough, which may affect the yield of the display component.

The existing inkjet printing apparatus using the solution method cannot meet the high-speed requirement of inkjet printing for a display component.

SUMMARY

Technical solutions of the embodiments of the present disclosure relate to an inkjet assembly for use in an inkjet printing apparatus. The inkjet assembly includes a jet printing member having a first surface, a main inkjet channel, a liquid-phase channel in communication with the main inkjet channel, and a gas-phase channel in communication with the main inkjet channel are formed in the jet printing member, an axial direction of the liquid-phase channel intersects an axial direction of the main inkjet channel, and an axial direction of the gas-phase channel intersects the axial direction of the main inkjet channel; and an end opening of the main inkjet channel is formed as a nozzle on the first surface.

Optionally, the liquid-phase channel includes a first-phase channel and a second-phase channel independent of each other, and the first-phase channel and the second-phase channel are in communication with the main inkjet channel, respectively, wherein an axial direction of the first-phase channel intersects the axial direction of the main inkjet channel, and an axial direction of the second-phase channel intersects the axial direction of the main inkjet channel.

Optionally, an intersection point of the second-phase channel with the main inkjet channel is located between an intersection point of the first-phase channel with the main inkjet channel and an intersection point of the gas-phase channel with the main inkjet channel, while the intersection point of the gas-phase channel with the main inkjet channel is located between the nozzle and the intersection point of the second-phase channel with the main inkjet channel.

Optionally, the jet printing member includes a nozzle plate, and a fluid channel plate disposed in stack with the nozzle plate, the first surface is formed on the nozzle plate, and the nozzle plate further has a second surface facing away from the first surface; the main inkjet channel includes a first main inkjet channel formed on the nozzle plate and a second main inkjet channel formed on the fluid channel plate, the first main inkjet channel and the second main inkjet channel being in communication with each other;

the fluid channel plate is provided on the second surface, the liquid-phase channel is formed on the fluid channel plate, and the gas-phase channel is formed on the fluid channel plate and/or the nozzle plate.

Optionally, a first groove is formed on the second surface of the nozzle plate, a surface of the fluid channel plate facing the nozzle plate encloses the gas-phase channel together with the first groove, and an end opening of the first groove intersects the first main inkjet channel.

Optionally, the fluid channel plate includes a first fluid channel plate, a second fluid channel plate, and a third fluid channel plate sequentially stacked, the third fluid channel plate is provided on the second surface and has a third surface facing the second surface and a fourth surface facing away from the third surface; the second fluid channel plate has a fifth surface facing the fourth surface and a sixth surface facing away from the fifth surface, the first fluid channel plate has a seventh surface facing the sixth surface and an eighth surface facing away from the seventh surface;

a second groove is formed on the sixth surface, the seventh surface encloses the first-phase channel together with the second groove, and an end opening of the second groove intersects the second main inkjet channel; and a third groove is formed on the fourth surface, the fifth surface encloses the second-phase channel together with the third groove, and an end opening of the third groove intersects the second main inkjet channel.

Optionally, the first fluid channel plate has a seventh surface facing the sixth surface and an eighth surface facing away from the seventh surface, the jet printing member further includes a first liquid inlet channel, a second liquid inlet channel and a gas inlet channel, the first liquid inlet channel includes a first main channel and a first micro channel in communication with each other, the first main channel has an inlet formed on the eighth surface, while the first micro channel communicates the first main channel with the first-phase channel;

the second liquid inlet channel includes a second main channel and a second micro channel, the second main channel has an inlet formed on the eighth surface, and runs through the first fluid channel plate, while the second micro channel runs through the second fluid channel plate and communicates the second main channel with the second-phase channel; and the gas-phase channel includes a third main channel and a third micro channel, the third main channel has an inlet formed on the eighth surface, and runs through the first fluid channel plate and the second fluid channel plate, while the third micro channel runs through the third fluid channel plate and communicates the third main channel with the gas-phase channel.

Optionally, the main inkjet channel has an inner diameter between 700 nm and 1 mm.

Optionally, the inkjet assembly includes a plurality of jet printing members arranged in an array.

Optionally, in each row of the jet printing members, every four successive jet printing members form a jet printing member group.

Optionally, the inkjet assembly is applied to a display component having RGBW sub-pixel cells.

Optionally, the intersection point of the gas-phase channel with the main inkjet channel is located between the nozzle and the intersection point of the liquid-phase channel with the main inkjet channel.

The present disclosure further provides an inkjet printing apparatus, including an inkjet assembly and an ink cartridge configured to provide a jet printing fluid to the inkjet assembly, the inkjet assembly being the inkjet assembly of the first aspect.

Optionally, the ink cartridge has a ninth surface on which the inkjet assembly is provided.

Optionally, the liquid-phase channel of the inkjet assembly includes a first-phase channel and a second-phase channel independent of each other and in communication with the main inkjet channel, respectively, wherein an axial direction of the first-phase channel intersects an axial direction of the main inkjet channel, and an axial direction of the second-phase channel intersects the axial direction of the main inkjet channel.

the ink cartridge includes a cartridge body including at least one first-phase ink reservoir, at least one second-phase ink reservoir and at least one gas-phase reservoir independent of each other, and the first-phase ink reservoir is in communication with the first-phase channel to supply the first-phase channel with a first-phase fluid, the second-phase ink reservoir is in communication with the second-phase channel to supply the second-phase channel with a second-phase fluid, and the gas-phase reservoir is in communication with the gas-phase channel to supply the gas-phase channel with a gas-phase fluid.

Optionally, the cartridge body is divided into two layers, with a first layer serving as the first-phase ink reservoir and/or second-phase ink reservoir, and a second layer providing channels through which the inkjet assembly communicates with the first-phase ink reservoir, the second-phase ink reservoir, and the gas-phase reservoir.

The present disclosure further provides an inkjet printing method for use in preparation of a display component, which performs inkjet printing using the inkjet printing apparatus as described above, wherein the method includes the steps of:

sending a starting instruction to a fluid source which, after receiving the starting instruction, introduces a liquid-phase fluid into the liquid-phase channel and a gas-phase fluid into the gas-phase channel;

spontaneously forming an end-to-end micro fluid from the liquid-phase fluid and the gas-phase fluid;

emitting, by the nozzle, jet printing droplets of the liquid-phase fluid and the gas-phase fluid alternately;

moving the jet printing droplets along a vertical direction into pixel cells of a substrate where the liquid-phase fluid is deposited while the gas-phase fluid is diffused into the environment for pixel cell printing;

sending, when printing of a current pixel cell is finished, a regulation instruction to a fluid source to increase a volume occupied by the gas-phase fluid in the main inkjet channel so that a time for the nozzle emitting the gas-phase fluid is longer than a moving time between different pixel cells of the substrate; and sending, when a next pixel cell to be jet printed moves to right below the inkjet assembly, another regulation instruction to the fluid source to reduce a volume occupied by the gas-liquid fluid in the main inkjet channel, so as to continue the pixel cell printing.

Optionally, the inkjet printing method further includes increasing the volume occupied by the gas-phase fluid in the main inkjet channel by increasing a flow rate and/or a single-pass time of the gas-phase fluid.

The present disclosure further provides an inkjet printing method for use in preparation of a display component, which performs inkjet printing using the inkjet printing apparatus as described above, wherein the method includes the steps of:

sending a starting instruction to a fluid source which, after receiving the starting instruction, introduces the first ink reservoir of the ink cartridge with a first-phase fluid, the second ink reservoir with a second-phase fluid, and the gas-phase reservoir with a gas-phase fluid, respectively;

encasing, after the first-phase fluid is mixed with the second-phase fluid, the first-phase fluid with the second-phase fluid to form a liquid-phase fluid;

spontaneously forming an end-to-end micro fluid from the liquid-phase fluid and the gas-phase fluid;

emitting, by the nozzle, jet printing droplets of the liquid-phase fluid and the gas-phase fluid alternately;

moving the jet printing droplets along a vertical direction into pixel cells of a substrate where the first-phase fluid is deposited, the second-phase fluid is volatilized, and the gas-phase fluid is diffused into the environment for pixel cell printing;

sending, when printing of a current pixel cell is finished, a regulation instruction to a fluid source to increase a volume occupied by the gas-phase fluid in the main inkjet channel so that a time for the nozzle emitting the gas-phase fluid is longer than a moving time between different pixel cells of the substrate; and sending, when a next pixel cell to be jet printed moves to right below the inkjet assembly, another regulation instruction to the fluid source to reduce a volume occupied by the gas-liquid fluid in the main inkjet channel, so as to continue the pixel cell printing.

Optionally, the inkjet printing apparatus further includes a micro pump, and wherein the inkjet printing method further includes the steps of:

sending a starting instruction to the micro pump; starting the micro pump to receive regulation parameters and control flow rates and velocities of the first-phase fluid and the second-phase fluid, so as to form a liquid-phase fluid of a specified size with the first-phase fluid encased by the second-phase fluid; and controlling the micro pump to continuously emit jet printing droplets of a specified size at a specified frequency.

DETAILED DESCRIPTION

Figure 1:
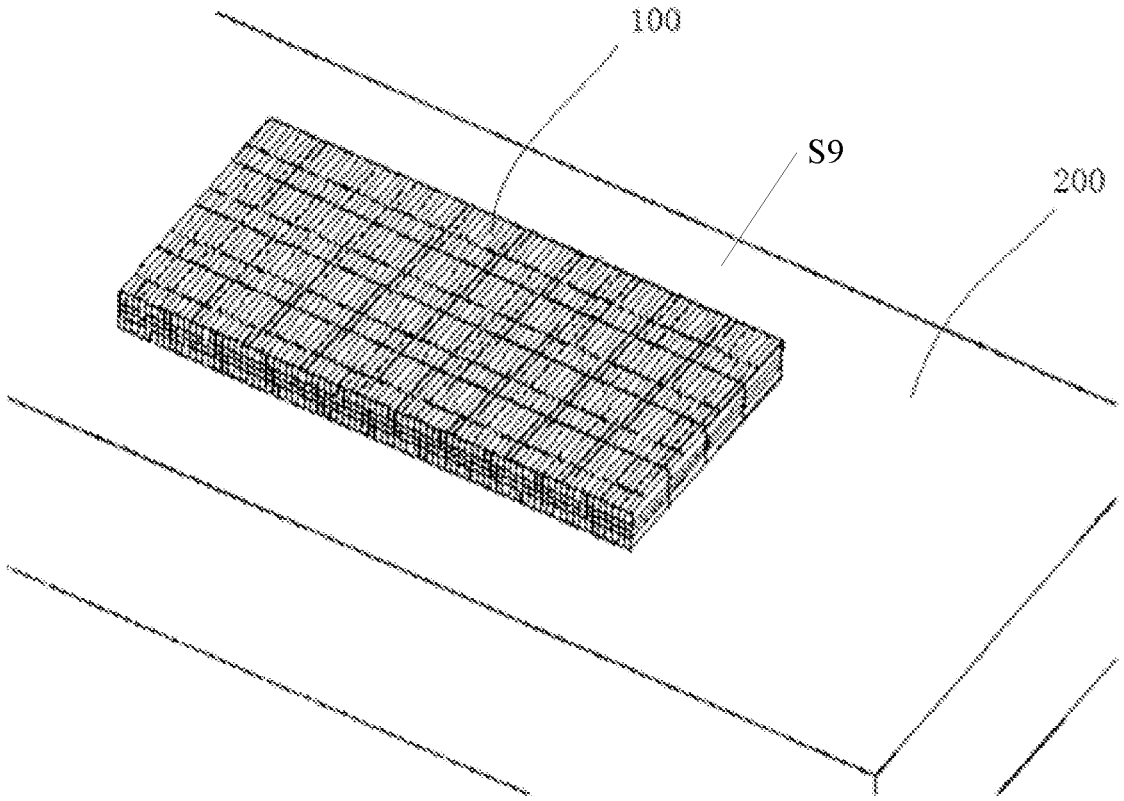
FIG. 1 is a rear structural view of an inkjet printing apparatus provided in an embodiment of the disclosure.

The present disclosure will now be described in detail below, and examples of embodiments of the present application will be shown in the drawings throughout which, the same or similar reference signs refer to the same or similar components or components with the same or similar functions. In addition, a detailed description of the known art is omitted if it is unnecessary for the shown features of the present disclosure. The embodiments described below with reference to the drawings are merely illustrative, and are used only for the purpose of explaining the disclosure and should not be interpreted as limitations to the disclosure.

It will be understood by those skilled in the art that, unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the prior art and will not be interpreted in an idealized or overly formal sense unless expressly so defined herein.

Those skilled in the art will understand that as used herein, the singular forms "a", "an", "the" and "said" are intended to include the plural forms as well, unless expressly stated otherwise. It will be understood that when an element is referred to as being "connected" or "coupled" to another element, it can be directly connected or coupled to the other element or intervening elements may also be present. Further, "connected" or "coupled" as used herein may include wirelessly connected or wirelessly coupled. As used herein, the term "and/or" includes all or any element and all combinations of one or more of the associated listed items.

The following describes the technical solution of the disclosure and how to solve the above technical problems in detail in conjunction with the accompany drawings and specific embodiments.

In an embodiment of the present disclosure, an inkjet assembly 100 is provided to be applicable to an inkjet printing apparatus as shown in FIG. 1. The inkjet assembly 100 can be used in preparation of a display component, particularly a light-emitting layer or a display layer in the display component. The inkjet printing apparatus using the inkjet assembly 100 can realize high-precision inkjet printing and real-time dynamic shutdown during the inkjet printing process, and thus suspension of the jet printing between different pixel cells of the substrate of the display component, so that the inkjet printing process of the display component can be completed at a high speed.

Figure 2:
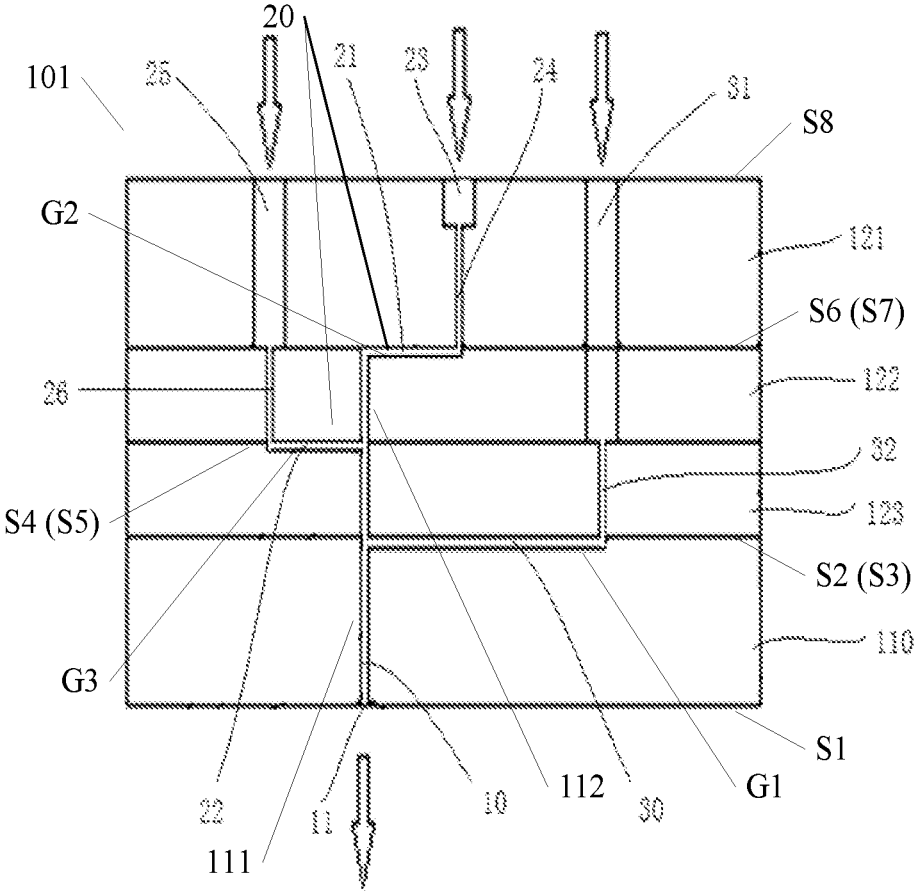
FIG. 2 is a schematic structural view of a jet printing member in an inkjet assembly provided in an embodiment of the disclosure.
Figure 3:
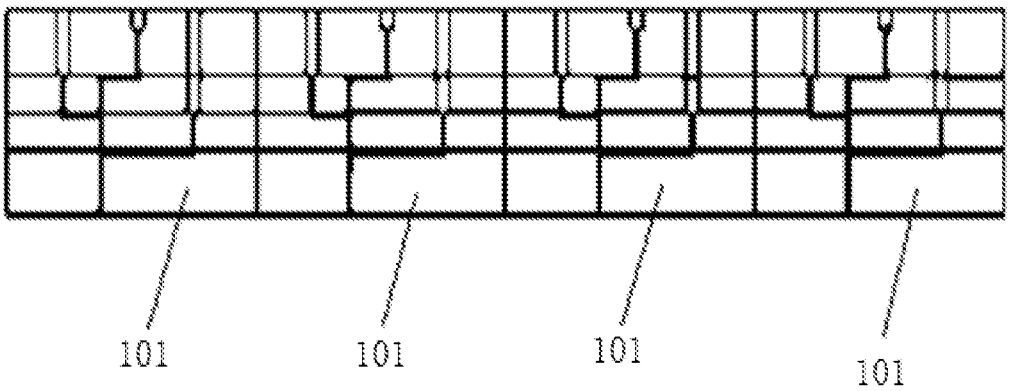
FIG. 3 is a schematic structural view of an inkjet assembly provided in an embodiment of the disclosure.

As shown in FIGS. 2 and 3, the inkjet assembly 100 may include at least one jet printing member 101 having a first surface S1. A main inkjet channel 10, a liquid-phase channel 20 in communication with the main inkjet channel 10, and a gas-phase channel 30 in communication with the main inkjet channel 10 may be formed in the jet printing member 101. An axial direction of the liquid-phase channel 20 may intersect an axial direction of the main inkjet channel 10, and an axial direction of the gas-phase channel 30 may also intersect the axial direction of the main inkjet channel 10. An end opening of the main inkjet channel 10 may be formed as a nozzle 11 on the first surface S1.

In the present disclosure, the first surface S1 may be understood as a surface of the inkjet assembly 100 facing a member to be printed (e.g., a substrate 300, including pixel cells to be inkjet printed). The fluid emitted from the nozzle 11 may include an inkjet printing ink, and may further include some volatile or diffusible liquids and gases.

Figure 4:
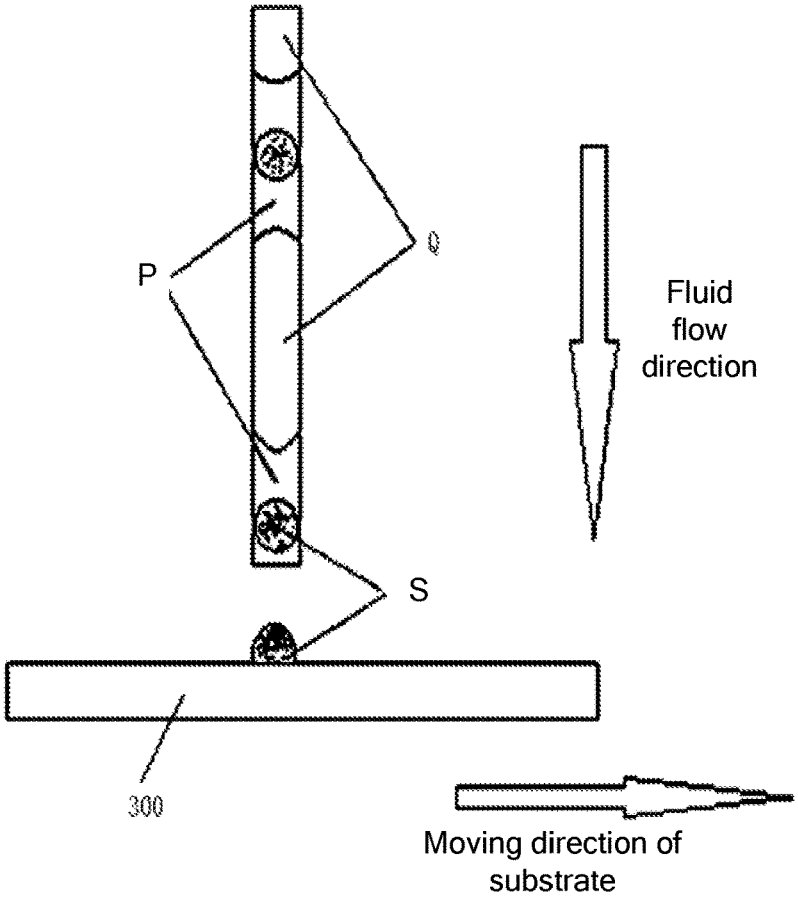
FIG. 4 is a schematic view illustrating the principle of inkjet printing provided in an embodiment of the disclosure.

As shown in FIGS. 2 to 4, the liquid-phase channel 20 and the gas-phase channel 30 are in communication with the main inkjet channel 10, respectively. A liquid-phase fluid (such as an ink for inkjet printing) may be introduced into the liquid-phase channel, a gas-phase fluid Q may be introduced into the gas-phase channel 30, and the liquid-phase fluid and the gas-phase fluid are not mutually fused. According to the arrangement characteristics of the fluid, flows of multiple phases which are not mutually fused will spontaneously cause a queuing phenomenon with different fluid droplets arranged at intervals within certain fluid characteristic and process parameter ranges. Using the above fluidic characteristics, embodiments of the present disclosure enables the liquid-phase fluid and the gas-phase fluid Q to spontaneously form end-to-end microfluidics within the main inkjet channel 10. Therefore, the nozzle 11 may emit the liquid-phase fluid and the gas-phase fluid Q alternately. The time during which the nozzle 11 emits the liquid-phase fluid may be referred to as a jet printing time, and the time during which the nozzle 11 emits the gas-phase fluid Q may be referred to as an interval time. When the inkjet printing of one pixel cell is completed, the nozzle 11 is moved at a relatively high speed between different pixel cells. During the high-speed movement, a flow rate and a single-pass time of the gas-phase fluid Q may be increased to increase a volume occupied by the gas-phase fluid Q in the main inkjet channel 10 so that the interval time between two times of jet printing is longer than a moving time between different pixel cells of the substrate 300 (a time for moving from one pixel cell to another). In other words, the time for the nozzle 11 emitting the gas-phase fluid Q is longer than the moving time. Therefore, the embodiment of the disclosure realizes real-time dynamic shutdown of the inkjet printing process, and thus suspension of the jet printing process during the movement between different pixel cells, so as to prevent the inkjet printing ink from being deposited on the bank between different pixel cells. Therefore, the embodiment of the disclosure can reach a new pixel cell for jet printing at a high speed after printing of the current pixel cell is finished so that the inkjet printing process of the display component can be completed at a high speed. In the above process, the emitted gas-phase fluid Q will diffuse into the environment without generating new droplets or affecting the thin film already formed. Therefore, the embodiment of the disclosure enables continuous inkjet printing with high precision and fast response, and meets the actual requirements of high-speed production.

It will be appreciated that the main inkjet channel 10, the liquid-phase channel 20 and the gas-phase channel 30 described above are all micro channels. Each of the micro channels described above may have a diameter equal to or greater than 700 nm and equal to or less than 1 mm, so as to form a micro fluid for inkjet printing in the main inkjet channel 10. The axial direction of the above liquid-phase channel 20 intersects the axial direction of the main inkjet channel 10 orthogonally or at an angle (not 90°). The axial direction of the gas-phase channel 30 also intersects the axial direction of the main inkjet channel 10 orthogonally or at an angle (not 90°), which is not specifically limited in the present disclosure, as long as the liquids in the liquid-phase channel 20 and in the gas-phase channel 30 can be mixed in the main inkjet channel 10 to form the micro fluid in which the liquid-phase fluid and the gas-phase fluid Q are connected end to end.

In an embodiment, an intersection point of the gas-phase channel 30 with the main inkjet channel 10 may be located between the nozzle 11 and the intersection point of the liquid-phase channel 20 with the main inkjet channel 10. With this arrangement, the micro fluid for inkjet printing may be firstly formed the main inkjet channel 10 so that introduction of the gas-phase fluid Q will not affect formation of the micro fluid for inkjet printing, and then the liquid-phase fluid and the gas-phase fluid Q may be introduced in any order or simultaneously, thereby facilitating operation and implementation of the process. It should be noted that this embodiment is merely one of the embodiments of the present disclosure, and the present disclosure is not limited thereto. It will work as long as the micro fluid in which the liquid-phase fluid and the gas-phase fluid Q are connected end to end is formed in the main inkjet channel 10.

As shown in FIG. 2, the liquid-phase channel 20 may include a first-phase channel 21 and a second-phase channel 22 independent of each other. The first-phase channel 21 and the second-phase channel 22 are in communication with the main inkjet channel 10, respectively. An axial direction of the first-phase channel 21 intersects the axial direction of the main inkjet channel 10, and an axial direction of the second-phase channel 22 intersects the axial direction of the main inkjet channel 10. As described above, the axial direction of the first-phase channel 21 and/or the second-phase channel 22 may intersect the axial direction of the main inkjet channel 10 orthogonally or at an angle (not 90°). On the basis, two liquid fluids of different phases which are not mutually fused may be introduced into the first-phase channel 21 and the second-phase channel 22, respectively, while a gas-phase fluid is introduced into the gas-phase channel 30. The two liquid fluids and the gas-phase fluid are mixed in the main inkjet channel 10, and a fluid configuration in which the liquid fluids and the gas fluid are alternated is formed using the arrangement characteristics of the fluids. This fluid configuration may form continuous jet printing droplets after being emitted from the nozzle. For example, a first-phase fluid S (e.g., a continuous-phase fluid) may be introduced into the first-phase channel 21, a second-phase fluid P (e.g., a dispersed-phase fluid) may be introduced into the second-phase channel 22, and a gas-phase fluid Q may be introduced into the gas-phase channel 30. The first-phase fluid S and the second-phase fluid P are mixed with the gas-phase fluid Q in the main inkjet channel 10, and the gas-phase fluid Q may form a switch bubble between continuous first-phase fluids S. In other words, in an embodiment of the present disclosure, the first-phase fluid S, the second-phase fluid P, and the gas-phase fluid Q form a continuous and alternate fluid configuration. In some embodiments, the first-phase fluid S may be a continuous-phase jet printing ink, and the second-phase fluid may be a dispersed-phase volatilizable fluid. When the first-phase fluid S, the second-phase fluid P and the gas-phase fluid Q are sequentially emitted from the nozzle 11, the first-phase fluid S is deposited on the substrate 300, the second-phase fluid P is volatilized into the environment, and the gas-phase fluid Q is diffused into the environment. Finally, only the required jet printing ink (the first-phase fluid S) is retained on the substrate 300, and the whole process of inkjet printing is completed.

In an embodiment, an intersection point of the second-phase channel 22 with the main inkjet channel 10 may be located between an intersection point of the first-phase channel 21 with the main inkjet channel 10 and an intersection point of the gas-phase channel 30 with the main inkjet channel 10. An intersection point of the gas-phase channel 30 with the main inkjet channel 10 may be located between the nozzle 11 and the intersection point of the second-phase channel 22 with the main inkjet channel 10. Thus, the two liquid fluids are first mixed in the main inkjet channel 10. Since one of the two phases of fluids has a shearing action on the other, stable jet printing droplets in which one phase of fluid encases the other phase may be formed. In some embodiments, stable jet printing droplets in which the second-phase fluid P encases the first-phase fluid S is formed under the above shearing action. In other words, the second-phase fluid P, as a volatilizable fluid, may encase the first-phase fluid S as a jet printing ink. In some embodiments, an inner diameter of the main inkjet channel 10, and flow rates and velocities of the fluids may be set to obtain jet printing droplets of a specified size and better size uniformity. After the jet printing droplets are mixed with the gas-phase fluid Q, the gas-phase fluid Q may form a switch bubble between the continuous-phase liquid drops. Thereby, the first-phase fluid S, the second-phase fluid P, and the gas-phase fluid Q form a continuous and alternate fluid configuration. In some embodiments, for example, when the second-phase fluid P encases the first-phase fluid S, the second-phase fluid P (encasing the first-phase fluid S) and the gas-phase fluid Q form a continuous and alternate fluid configuration.

In some embodiments, the gas-phase fluid Q may be an inert gas. The inert gas can form separation between continuous jet printing droplets without reacting with the jet printing droplets or influencing emission of the jet printing droplets, or the like.

In some embodiments, the interval time between successive emissions of the jet printing droplets (the time for the nozzle emitting the gas-phase fluid Q) may be controlled by changing parameters of the gas-phase fluid Q, thereby realizing a dynamic switch characteristic with fast response of the jet printing action. In some embodiments, changing parameters of the gas-phase fluid Q may include adjusting an input flow rate of the gas-phase fluid Q, increasing a pass time of the gas-phase fluid Q, and so on. When the jet printing of the current pixel cell is finished, in order to realize dynamic shutdown of the jet printing process and complete the inkjet printing of the display component, instead of shutting down the input of the first-phase fluid S and the second-phase fluid P, the jet printing member 101 only needs to adjust the parameters of the gas-phase fluid Q through a control circuit to make the interval time between two times of jet printing (the time when the nozzle emits the first-phase fluid S and the second-phase fluid P) longer than the moving time of the substrate 300.

In a specific embodiment of the present disclosure, the jet printing member 101 may include a nozzle plate 110, and a fluid channel plate 120 disposed in stack with the nozzle plate 110. The nozzle plate 110 has the above-described first surface S1 and a second surface S2 facing away from the first surface S1. The fluid channel plate 120 may be provided on the second surface S2. The liquid-phase channel 20 may be formed on the fluid channel plate 120, and the gas-phase channel 30 may be formed on the fluid channel plate 120 and/or the nozzle plate 110. The main inkjet channel 10 may include a first main inkjet channel 111 formed on the nozzle plate 110 and a second main inkjet channel 112 formed on the fluid channel plate 120. The first main inkjet channel 111 and the second main inkjet channel 112 are in communication with each other. Therefore, by providing the nozzle plate 110 and the fluid channel plate 120 in stack, the main inkjet channel 10, the liquid-phase channel 20, and the gas-phase channel 30 may be respectively processed on the nozzle plate 110 and the fluid channel plate 120, which reduces the difficulty of machining, facilitates the process implementation, and improves the production efficiency.

Optionally, a first groove G1 may be formed on the second surface S2 of the nozzle plate 110. A surface of the fluid channel plate 120 facing the nozzle plate 110 encloses the gas-phase channel 30 together with a first groove G1, and an end opening of the first groove G1 intersects the first main inkjet channel 111 (i.e., at the intersection point of the gas-phase channel 30 with the main inkjet channel 10). Therefore, by providing the first groove G1 on the surface of the nozzle plate 110, the first groove G1 and the second surface S2 of the nozzle plate 110 jointly enclose the gas-phase channel 30, which facilitates machining of the gas-phase channel 30 and thus implementation of the process.

It should be noted that in the embodiment of the present disclosure, the materials and the processing manners of the nozzle plate 110 and the fluid channel plate 120 are not particularly limited. For example, the fluid channel plate 120 may be made of an inorganic non-metal (e.g., silicon, glass) or an organic material (e.g., PMMA), while the nozzle plate 110 may be made of silicon. Optionally, the micro channels (respective micro channel structures) of the fluid channel plate 120 and the nozzle plate 110 may be made through a semiconductor process, and the fluid channel plate 120 and the nozzle plate 110 may be bonded or adhered to each other to form a 3D two-phase flow micro channel structure.

As shown in FIG. 2, the fluid channel plate 120 may include a first fluid channel plate 121, a second fluid channel plate 122, and a third fluid channel plate 123 sequentially stacked. The third fluid channel plate 123 is provided on the second surface S2 and has a third surface S3 facing the second surface S2 and a fourth surface S4 facing away from the third surface S3. The second fluid channel plate 122 has a fifth surface S5 facing the fourth surface S4 and a sixth surface S6 facing away from the fifth surface S5. The first fluid channel plate 121 has a seventh surface S7 facing the sixth surface S6 and an eighth surface S8 facing away from the seventh surface S7. A second groove G2 may be formed on the sixth surface S6, the seventh surface encloses the first-phase channel 21 together with the second groove G2, and an end opening of the second groove G2 intersects the second main inkjet channel 112 (i.e., at the intersection point of the first-phase channel 21 with the main inkjet channel 10). A third groove G3 may be formed on the fourth surface S4, the fifth surface S5 encloses the second-phase channel 22 together with the third groove G3, and an end opening of the third groove G3 intersects the second main inkjet channel 112 (i.e., at the intersection point of the second-phase channel 22 with the main inkjet channel 10). Therefore, in order to form the first-phase channel 21, the second-phase channel 22, and the gas-phase channel 30, grooves (G1, G2 and G3) extending along an in-plane direction may be opened on the surface of the fluid channel plate 120 to facilitate machining of the fluid channel plate 120. Optionally, adjacent two of the first fluid channel plate 121, the second fluid channel plate 122 and the third fluid channel plate 123 may also be bonded or adhered to each other.

It should be noted that the above arrangement of the first-phase channel 21, the second-phase channel 22 and the gas-phase channel 30 is merely one of the embodiments of the disclosure, and the disclosure is not limited thereto. For example, in some embodiments, a first groove G1 may be formed on the third surface S3, and the second surface S2 may enclose the gas-phase channel 30 with the first groove G1; a second groove G2 may be formed on the seventh surface S7, and the sixth surface S6 encloses the first-phase channel 21 together with the second groove G2; and a third groove G3 may be formed on the fifth surface S5, and the fourth surface S4 encloses the second-phase channel 22 together with the third groove G3. In some embodiments, a first upper groove may be formed on the third surface S3, a first lower groove may be formed on the second surface S2 at a position corresponding to the first upper groove, and the first upper groove encloses the gas-phase channel 30 with the first lower groove; a second upper groove may be formed on the seventh surface S7, a second lower groove may be formed on the sixth surface S6 at a position corresponding to the second upper groove, and the second upper groove encloses the first-phase channel 21 with the second lower groove; and a third upper groove may be formed on the fifth surface S5, a third lower groove may be formed on the fourth surface S4 at a position corresponding to the third upper groove, and the third upper groove encloses the second-phase channel 22 with the third lower groove.

In another specific embodiment of the disclosure, the jet printing member 101 may further include a first liquid inlet channel, a second liquid inlet channel, and a gas inlet channel. The first liquid inlet channel may include a first main channel 23 and a first micro channel 24 in communication with each other, the first main channel 23 may have an inlet formed on the eighth surface S8, while the first micro channel 24 communicates the first main channel 23 with the first-phase channel 21. The second liquid inlet channel may include a second main channel 25 and a second micro channel 26, and the second main channel 25 may have an inlet formed on the eighth surface S8. The second main channel 25 runs through the first fluid channel plate 121, the second micro channel 26 runs through the second fluid channel plate 122, and the second micro channel 26 communicates the second main channel 25 with the second-phase channel 22. The gas-phase channel 30 may include a third main channel 31 and a third micro channel 32, and the third main channel 31 may have an inlet formed on the eighth surface S8. The third main channel 31 runs through the first fluid channel plate 121 and the second fluid channel plate 122, the third micro channel 32 runs through the third fluid channel plate 123, and the third micro channel 32 communicates the third main channel 31 with the gas-phase channel 30.

In this embodiment, the first main channel 23 may have an inner diameter much greater than the first micro channel 24 and the first-phase channel 21, the second main channel 25 may have an inner diameter much greater than the second micro channel 26 and the second-phase channel 22, and the third main channel 31 may have an inner diameter much greater than the third micro channel 32 and the gas-phase channel 30, so that the first-phase fluid S is introduced into the first-phase channel 21 via the first main channel 23, the second-phase fluid P is introduced into the second-phase channel 22 via the second main channel 25, and the gas-phase fluid Q is introduced into the gas-phase channel 30 via the third main channel 31. Optionally, the first main channel 23, the second main channel 25 and the third main channel 31 may be all vertically provided; the first micro channel 24 may be provided coaxially with the first main channel 23, the second micro channel 26 may be provided coaxially with the second main channel 25, and the third micro channel 32 may be provided coaxially with the third main channel 31; and the first-phase channel 21, the second-phase channel 22, and the gas-phase channel 30 may be horizontally provided.

It should be noted that the above structure of the first-phase channel 21, the second-phase channel 22 and the gas-phase channel 30 is merely one of the embodiments of the disclosure, and the disclosure is not limited thereto, as long as the liquid-phase channel 20, the gas-phase channel 30 and the main inkjet channel 10 as described above can be formed, and dynamic shutdown of the liquid-phase fluid can be realized by introducing the gas-phase fluid Q.

In another specific embodiment of the disclosure, the inkjet assembly 100 may include a plurality of jet printing members 101 arranged in an array, so as to increase the jet printing density and area per unit time, and thus achieve characteristics of the inkjet printing such as high efficiency, high precision, and fast response.

Optionally, as shown in FIG. 3, the inkjet assembly 100 may be applied to a display component using the RGBW technology, i.e., a display component in which a white sub-pixel cell is added in addition to RGB. The number of jet printing members 101 included in the inkjet assembly 100 may be an integral multiple of four. In each row of the jet printing members, each successive four of the jet printing members 101 form a jet printing member group, and each row may include at least one jet printing member group. The four jet printing members 101 of each jet printing member group may be used to emit white jet printing droplets, blue jet printing droplets, green jet printing droplets, and red jet printing droplets, respectively.

Based on the same concept as the inkjet assembly 100, an embodiment of the present disclosure provides an inkjet printing apparatus, which may include an inkjet assembly 100 and an ink cartridge 200 configured to provide a jet printing fluid to the inkjet assembly 100. The inkjet assembly 100 may be the inkjet assembly 100 according to any of the above implementations.

The inkjet printing apparatus provided in the embodiment of the present disclosure includes the inkjet assembly 100 according to any of the above implementations, and can achieve at least beneficial effects that can be achieved by the inkjet assembly 100, which are not repeated here.

As shown in FIG. 1, the ink cartridge 200 may have a ninth surface S9 on which the inkjet assembly 100 may be provided. Optionally, the inkjet assembly 100 may be secured to the ink cartridge 200 by bonding or adhering.

Figure 5:
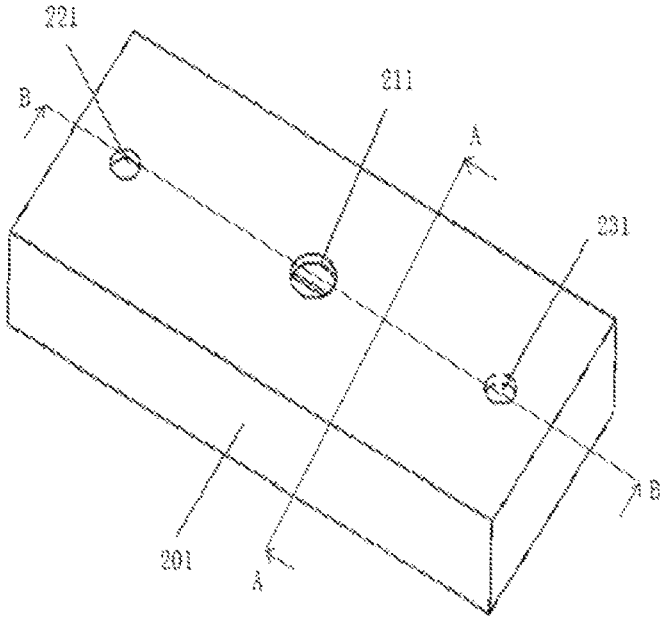
FIG. 5 is a 3D structural view of an ink cartridge provided in an embodiment of the disclosure.
Figure 6:
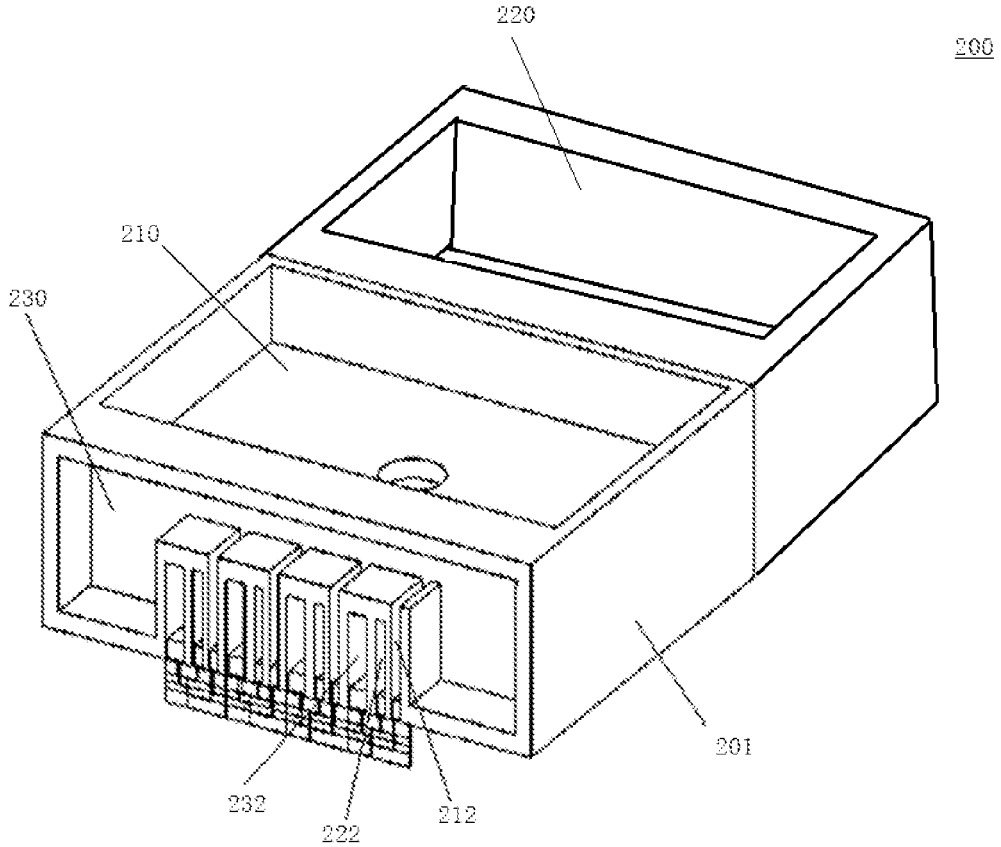
FIG. 6 is an internal schematic view of the sectional 3D structure taken along A-A in FIG. 5.
Figure 7:
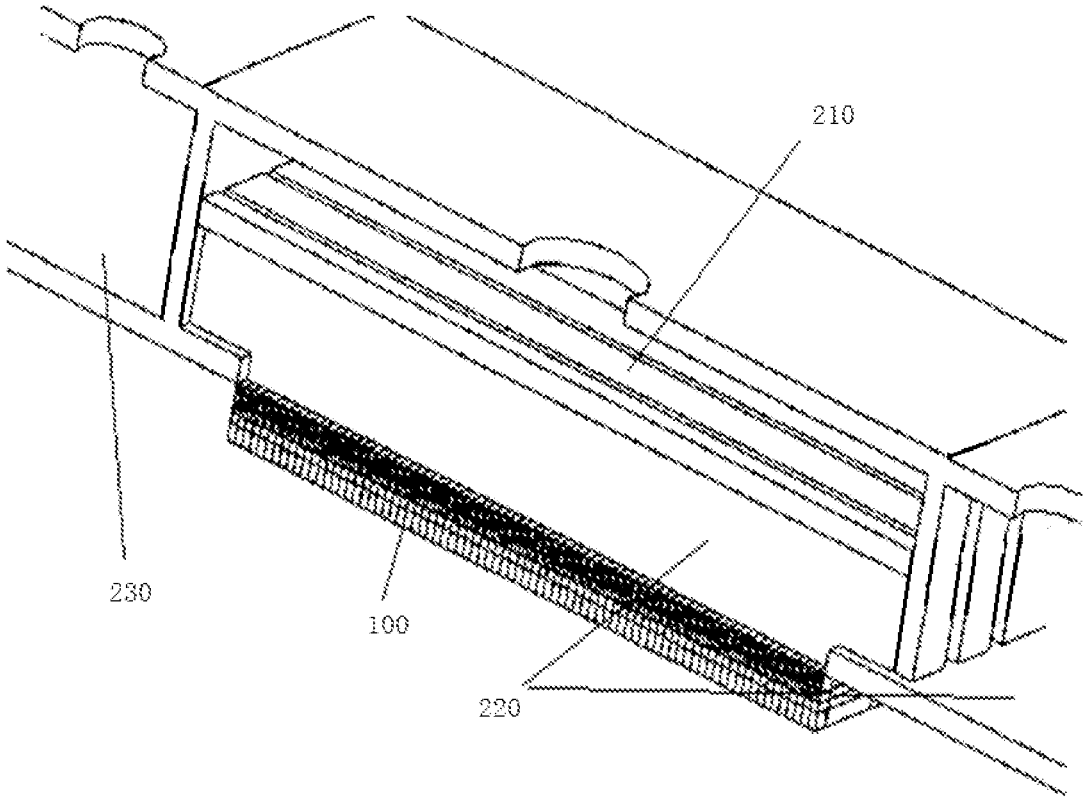
FIG. 7 is an internal schematic view of the sectional 3D structure taken along B-B in FIG. 5.

As shown in FIGS. 5 to 7, when the liquid-phase channel 20 of the inkjet assembly 100 includes the first-phase channel 21 and the second-phase channel 22 as described above, the ink cartridge 200 may include a cartridge body 201 that may include at least one first-phase ink reservoir 210, at least one second-phase ink reservoir 220 and at least one gas-phase reservoir 230 independent of each other. The first-phase ink reservoir 210 is in communication with the first-phase channel 21 to supply the first-phase channel 21 with a first-phase fluid S; The second-phase ink reservoir 220 is in communication with the second-phase channel 22 to supply the second-phase channel 22 with a second-phase fluid P; and the gas-phase reservoir 230 is in communication with the gas-phase channel 30 to supply the gas-phase channel 30 with a gas-phase fluid Q. The first-phase channel 21, the second-phase channel 22, and the gas-phase channel 30 may be in communication with the micro pump(s), respectively. When fluids are to be introduced into the inkjet assembly 100, a first-phase fluid S may be introduced into the first-phase ink reservoir 210, a second-phase fluid P may be introduced into the second-phase ink reservoir, and a gas-phase fluid Q may be introduced into the gas-phase reservoir 230, while the micro pump is activated to pump the first-phase fluid S, the second-phase fluid P, and the gas-phase fluid Q to the inkjet assembly 100 for inkjet printing. It should be noted that the specific structure and material of the ink cartridge 200 are not particularly limited in the embodiment of the present disclosure, as long as it can supply the fluid for inkjet printing to the inkjet assembly 100. The present disclosure does not specifically limit the structure, material and quantity of the micro pumps, either. For example, one micro pump may be provided, or one micro pump may be provided for each of the first-phase channel 21, the second-phase channel 22, and the gas-phase channel 30.

Optionally, the cartridge body 201 further has a tenth surface S10 facing away from the ninth surface S9. The tenth surface S10 may be provided with an inlet 211 of the first-phase ink reservoir 210, an inlet 221 of the second-phase ink reservoir 220, and an inlet 231 of the gas-phase reservoir 230 thereon, respectively. The first-phase ink reservoir 210 and the inlet 211 thereof may be located in the middle of the cartridge body 201, while the second-phase ink reservoir 220 and the inlet 221 thereof, as well as the gas-phase reservoir 230 and the inlet 231 thereof, may be provided at two ends of the cartridge body 201. The middle of the ink cartridge body 201 may be divided into two layers with an upper layer serving as the first-phase ink reservoir 210 (further including the second-phase ink reservoir in some embodiments), and a lower layer for arranging channels of the inkjet assembly 100 in communication with the respective ink reservoirs or for storing the jet printing ink that may be used in a large quantity. For example, the first-phase ink reservoir 210 may vertically communicate with the first-phase channel 21 through a first flow guide channel 212 in the lower middle layer of the cartridge body 201, the second-phase ink reservoir 220 may horizontally communicate with the second-phase channel 22 through a second flow guide channel 222 in the lower middle layer of the cartridge body 201, and the gas-phase reservoir 230 may horizontally communicate with the gas-phase channel 30 through a third flow guide channel 232 in the lower middle layer of the cartridge body 201, so that the above phases of fluids can be introduced into the jet printing member. In some embodiments, operations of the inkjet assembly 100 and the ink cartridge 200 may be realized by an overall control device of the inkjet printing apparatus, or can be realized by respective control assemblies, which are not limited herein.

Based on the same concept as the inkjet assembly 100, an embodiment of the present disclosure provides an inkjet printing method that uses the inkjet printing apparatus according to any of the above implementations and that includes the steps of: sending a starting instruction to a fluid source which, after receiving the starting instruction, introduces a liquid-phase fluid into the liquid-phase channel 20 and a gas-phase fluid into the gas-phase channel 30; spontaneously forming an end-to-end micro fluid from the liquid-phase fluid and the gas-phase fluid Q; emitting, by the nozzle 11, jet printing droplets of the liquid-phase fluid and the gas-phase fluid alternately; moving the jet printing droplets along a vertical direction into pixel cells of a substrate 300, where the liquid-phase fluid is deposited in the pixel cells of the substrate 300, and the gas-phase fluid Q is diffused into the environment for pixel cell printing; sending, when printing of a current pixel cell is finished, a regulation instruction to a fluid source to increase a volume occupied by the gas-phase fluid Q in the main inkjet channel 10 so that the interval time between two times of jet printing is longer than a moving time between different pixel cells of the substrate 300 (a time for moving from one pixel cell to another), i.e., the time for the nozzle 11 emitting the gas-phase fluid Q is longer than the moving time; and sending, when a next pixel cell to be jet printed moves to right below the inkjet assembly 100, another regulation instruction to the fluid source to reduce a volume occupied by the gas-liquid Q in the main inkjet channel 10, so as to continue the pixel cell printing. In this manner, real-time dynamic shutdown of the inkjet printing process, and thus suspension of the jet printing process between different pixel cells are realized, thereby completing the inkjet printing process of the display component.

In some embodiments, the method of printing a display component with the inkjet printing apparatus may further include: increasing a flow rate and/or a single-pass time of the gas-phase fluid Q to increase a volume occupied by the gas-phase fluid Q in the main inkjet channel 10.

In some embodiments, the method of printing a display component with the inkjet printing apparatus may further include: sending a starting instruction to a fluid source which, after receiving the starting instruction, introduces the first ink reservoir 210 of the ink cartridge 200 with a first-phase fluid S, the second ink reservoir 220 with a second-phase fluid P, and the gas-phase reservoir 230 with a gas-phase fluid Q, respectively; encasing, after the first-phase fluid S is mixed with the second-phase fluid P, the first-phase fluid S with the second-phase fluid P to form a liquid-phase fluid; and moving the jet printing droplets along a vertical direction into pixel cells of a substrate 300 where the first-phase fluid S is deposited, the second-phase fluid P is volatilized, and the gas-phase fluid Q is diffused into the environment for pixel cell printing.

In some embodiments, the method of printing a display component with the inkjet printing apparatus may further include: sending a starting instruction to the micro pump; starting the micro pump to receive regulation parameters and control flow rates and velocities of the first-phase fluid S and the second-phase fluid P, so as to form a liquid-phase fluid of a specified size with the first-phase fluid S encased by the second-phase fluid P; and controlling the micro pump to continuously emit jet printing droplets of a specified size at a specified frequency.

Those skilled in the art will understand that various operations, methods, steps in the flow, measures, solutions discussed in this disclosure can be alternated, modified, combined, or deleted.

It will be appreciated that in the description of the present disclosure, orientation or positional relationships referred by terms "central", "upper", "lower", "front", "back", "left", "right", "vertical", "horizontal", "top", "bottom", "inside", "outside" and the like are based on the orientation or positional relationship shown in the drawings, and are merely for facilitating description of the disclosure and simplifying the description, instead of indicting or implying that the device or component referred to must have a specific orientation or must be configured or operated at a specific orientation, and thus cannot be interpreted as limitations to the present disclosure.

The foregoing is merely part of the implementations of the present disclosure, and it should be noted that modifications and refinements may be made by those skilled in the art without departing from the principles of the disclosure and these modifications and refinements should be considered as within the scope of the disclosure.

What is claimed is:

1. An inkjet assembly for use in preparation of a display component, wherein the inkjet assembly comprises a jet printing member having a first surface, wherein a main inkjet channel, a liquid-phase channel in communication with the main inkjet channel, and a gas-phase channel in communication with the main inkjet channel are formed in the jet printing member, an axial direction of the liquid-phase channel intersects an axial direction of the main inkjet channel, and an axial direction of the gas-phase channel intersects the axial direction of the main inkjet channel; and an end opening of the main inkjet channel is formed as a nozzle on the first surface.

2. The inkjet assembly according to claim 1, wherein the liquid-phase channel comprises a first-phase channel and a second-phase channel independent of each other, and the first-phase channel and the second-phase channel are in communication with the main inkjet channel, respectively, wherein an axial direction of the first-phase channel intersects the axial direction of the main inkjet channel, and an axial direction of the second-phase channel intersects the axial direction of the main inkjet channel.

3. The inkjet assembly according to claim 2, wherein an intersection point of the second-phase channel with the main inkjet channel is located between an intersection point of the first-phase channel with the main inkjet channel and an intersection point of the gas-phase channel with the main inkjet channel, while the intersection point of the gas-phase channel with the main inkjet channel is located between the nozzle and the intersection point of the second-phase channel with the main inkjet channel.

4. The inkjet assembly according to claim 2, wherein the jet printing member comprises a nozzle plate, and a fluid channel plate disposed in stack with the nozzle plate, the first surface is formed on the nozzle plate, and the nozzle plate further has a second surface facing away from the first surface;

the main inkjet channel comprises a first main inkjet channel formed on the nozzle plate and a second main inkjet channel formed on the fluid channel plate, the first main inkjet channel and the second main inkjet channel being in communication with each other; and the fluid channel plate is provided on the second surface, the liquid-phase channel is formed on the fluid channel plate, and the gas-phase channel is formed on the fluid channel plate and/or the nozzle plate.

5. The inkjet assembly according to claim 4, wherein a first groove is formed on the second surface of the nozzle plate, a surface of the fluid channel plate facing the nozzle plate encloses the gas-phase channel together with the first groove, and an end opening of the first groove intersects the first main inkjet channel.

6. The inkjet assembly according to claim 4, wherein the fluid channel plate comprises a first fluid channel plate, a second fluid channel plate, and a third fluid channel plate sequentially stacked, the third fluid channel plate is provided on the second surface and has a third surface facing the second surface and a fourth surface facing away from the third surface;

the second fluid channel plate has a fifth surface facing the fourth surface and a sixth surface facing away from the fifth surface;

the first fluid channel plate has a seventh surface facing the sixth surface and an eighth surface facing away from the seventh surface;

a second groove is formed on the sixth surface, the seventh surface encloses the first-phase channel together with the second groove, and an end opening of the second groove intersects the second main inkjet channel; and a third groove is formed on the fourth surface, the fifth surface encloses the second-phase channel together with the third groove, and an end opening of the third groove intersects the second main inkjet channel.

7. The inkjet assembly according to claim 4, wherein the first fluid channel plate has a seventh surface facing the sixth surface and an eighth surface facing away from the seventh surface, the jet printing member further comprises a first liquid inlet channel, a second liquid inlet channel and a gas inlet channel, the first liquid inlet channel comprises a first main channel and a first micro channel in communication with each other, the first main channel has an inlet formed on the eighth surface, while the first micro channel communicates the first main channel with the first-phase channel;

the second liquid inlet channel comprises a second main channel and a second micro channel, the second main channel has an inlet formed on the eighth surface, and runs through the first fluid channel plate, while the second micro channel runs through the second fluid channel plate and communicates the second main channel with the second-phase channel; and the gas-phase channel comprises a third main channel and a third micro channel, the third main channel has an inlet formed on the eighth surface, and runs through the first fluid channel plate and the second fluid channel plate, while the third micro channel runs through the third fluid channel plate and communicates the third main channel with the gas-phase channel.

8. The inkjet assembly according to claim 1, wherein the main inkjet channel has an inner diameter between 700 nm and 1 mm.

9. The inkjet assembly according to claim 1, wherein the inkjet assembly comprises a plurality of jet printing members arranged in an array.

10. The inkjet assembly according to claim 9, wherein in each row of the jet printing members, every four successive jet printing members form a jet printing member group.

11. The inkjet assembly according to claim 10, wherein the inkjet assembly is applied to a display component having RGBW sub-pixel cells.

12. The inkjet assembly according to claim 1, wherein the intersection point of the gas-phase channel with the main inkjet channel is located between the nozzle and the intersection point of the liquid-phase channel with the main inkjet channel.

13. An inkjet printing apparatus for use in preparation of a display component, comprising an inkjet assembly and an ink cartridge configured to provide a jet printing fluid to the inkjet assembly, wherein the inkjet assembly is the inkjet assembly of claim 1.

14. The inkjet printing apparatus according to claim 13, wherein the ink cartridge has a ninth surface on which the inkjet assembly is provided.

15. The inkjet printing apparatus according to claim 13, wherein the liquid-phase channel of the inkjet assembly comprises a first-phase channel and a second-phase channel independent of each other and in communication with the main inkjet channel, respectively, wherein an axial direction of the first-phase channel intersects an axial direction of the main inkjet channel, and an axial direction of the second-phase channel intersects the axial direction of the main inkjet channel, the ink cartridge comprises a cartridge body comprising at least one first-phase ink reservoir, at least one second-phase ink reservoir and at least one gas-phase reservoir independent of each other, and the first-phase ink reservoir is in communication with the first-phase channel to supply the first-phase channel with a first-phase fluid; the second-phase ink reservoir is in communication with the second-phase channel to supply the second-phase channel with a second-phase fluid;

and the gas-phase reservoir is in communication with the gas-phase channel to supply the gas-phase channel with a gas-phase fluid.

16. The inkjet printing apparatus according to claim 15, wherein the cartridge body is divided into two layers, with a first layer serving as the first-phase ink reservoir and/or second-phase ink reservoir, and a second layer providing channels through which the inkjet assembly communicates with the first-phase ink reservoir, the second-phase ink reservoir, and the gas-phase reservoir.

17. An inkjet printing method for use in preparation of a display component, which performs inkjet printing using the inkjet printing apparatus of claim 15, wherein the method comprises the steps of:

sending a starting instruction to a fluid source, after receiving the starting instruction, the fluid source introduces the first ink reservoir of the ink cartridge with a first-phase fluid, the second ink reservoir with a second-phase fluid, and the gas-phase reservoir with a gas-phase fluid, respectively;

encasing, after the first-phase fluid is mixed with the second-phase fluid, the first-phase fluid with the second-phase fluid to form a liquid-phase fluid;

spontaneously forming an end-to-end micro fluid from the liquid-phase fluid and the gas-phase fluid;

emitting, by the nozzle, jet printing droplets of the liquid-phase fluid and the gas-phase fluid alternately;

moving the jet printing droplets along a vertical direction into pixel cells of a substrate where the first-phase fluid is deposited, the second-phase fluid is volatilized, and the gas-phase fluid is diffused into the environment for pixel cell printing;

sending, when printing of a current pixel cell is finished, a regulation instruction to a fluid source to increase a volume occupied by the gas-phase fluid in the main inkjet channel so that a time for the nozzle emitting the gas-phase fluid is longer than a moving time between different pixel cells of the substrate; and sending, when a next pixel cell to be jet printed moves to right below the inkjet assembly, another regulation instruction to the fluid source to reduce a volume occupied by the gas-liquid fluid in the main inkjet channel, so as to continue the pixel cell printing.

18. The inkjet printing method according to claim 17, wherein the inkjet printing apparatus further comprises a micro pump, and wherein the inkjet printing method further comprises the steps of:

sending a starting instruction to the micro pump;

starting the micro pump to receive regulation parameters and control flow rates and velocities of the first-phase fluid and the second-phase fluid, so as to form a liquid-phase fluid of a specified size with the first-phase fluid encased by the second-phase fluid; and controlling the micro pump to continuously emit jet printing droplets of a specified size at a specified frequency.

19. An inkjet printing method for use in preparation of a display component, which performs inkjet printing using the inkjet printing apparatus of claim 13, wherein the method comprises the steps of:

sending a starting instruction to a fluid source, after receiving the starting instruction, and the fluid source introduces a liquid-phase fluid into the liquid-phase channel and a gas-phase fluid into the gas-phase channel;

spontaneously forming an end-to-end micro fluid from the liquid-phase fluid and the gas-phase fluid;

emitting, by the nozzle, jet printing droplets of the liquid-phase fluid and the gas-phase fluid alternately;

moving the jet printing droplets along a vertical direction into pixel cells of a substrate where the liquid-phase fluid is deposited while the gas-phase fluid is diffused into the environment for pixel cell printing;

sending, when printing of a current pixel cell is finished, a regulation instruction to a fluid source to increase a volume occupied by the gas-phase fluid in the main inkjet channel so that a time for the nozzle emitting the gas-phase fluid is longer than a moving time between different pixel cells of the substrate; and sending, when a next pixel cell to be jet printed moves to right below the inkjet assembly, another regulation instruction to the fluid source to reduce a volume occupied by the gas-liquid fluid in the main inkjet channel, so as to continue the pixel cell printing.

20. The inkjet printing method according to claim 19, wherein the inkjet printing method further comprises the steps of:

increasing the volume occupied by the gas-phase fluid in the main inkjet channel by increasing a flow rate and/or a single-pass time of the gas-phase fluid.

* * * * *